US006513646B1

(12) United States Patent
Olsen

(10) Patent No.: US 6,513,646 B1
(45) Date of Patent: Feb. 4, 2003

(54) CONVEYOR SYSTEMS, STABILIZER ASSEMBLIES AND METHODS FOR STABILIZING CONVEYOR CARRIERS

(75) Inventor: Richard Olsen, Burlington (CA)

(73) Assignee: Jervis B. Webb Company, Farmington Hills, MI (US)

( * ) Notice: Subject to any disclaimer, the term of this patent is extended or adjusted under 35 U.S.C. 154(b) by 0 days.

(21) Appl. No.: 09/908,832

(22) Filed: Jul. 20, 2001

(51) Int. Cl.[7] ..... B65G 29/00
(52) U.S. Cl. ..... 198/465.4; 198/343.1
(58) Field of Search ..... 198/343.3, 465.4, 198/678.1, 680, 683; 104/189, 165, 172.1

(56) References Cited

U.S. PATENT DOCUMENTS

| | | | | |
|---|---|---|---|---|
| 2,336,551 A | | 12/1943 | Kumler | |
| 2,351,990 A | | 6/1944 | Matlock | |
| 2,628,702 A | | 2/1953 | Mabrey | |
| 2,971,474 A | | 2/1961 | Klamp | |
| 3,115,846 A | | 12/1963 | Dehne | |
| 3,426,700 A | | 2/1969 | Klamp | |
| 3,443,526 A | | 5/1969 | Gee | |
| 3,683,817 A | | 8/1972 | Macomber et al. | |
| 4,341,161 A | | 7/1982 | Morita et al. | |
| 4,408,539 A | | 10/1983 | Wakabayashi | |
| 4,724,944 A | | 2/1988 | Koshigai et al. | |
| 4,729,466 A | | 3/1988 | Bollier et al. | |
| 5,303,655 A | | 4/1994 | Summa et al. | |
| 5,606,915 A | | 3/1997 | Harris | |
| 5,667,056 A | * | 9/1997 | Kimmet | 198/465.4 X |
| 5,927,472 A | | 7/1999 | Neef et al. | |
| 5,927,481 A | * | 7/1999 | Engman et al. | 198/465.4 X |
| 6,367,612 B1 | * | 4/2002 | Dosso et al. | 198/465.4 |
| 6,378,440 B1 | * | 4/2002 | Rhodes | 198/343.1 X |

* cited by examiner

*Primary Examiner*—James R. Bidwell
(74) *Attorney, Agent, or Firm*—Dickinson Wright PLLC

(57) ABSTRACT

A stabilizer assembly for use with a conveyer system includes a stabilizer member that pivots from a first position to a second position towards a vertically-curved track section as a conveyor carrier moves into the vertically-curved section. A method for stabilizing a conveyor carrier includes installing a stabilizer member adjacent to the vertically-curved section of the conveyor track, and pivoting the stabilizer member from a first vertical position towards a second position as the conveyor carrier moves into the vertically-curved section of the conveyor track. A conveyor system includes a conveyor track having a vertically-curved section, a conveyor carrier placed on the conveyor track for traveling along the conveyor track, and a stabilizer assembly that includes a stabilizer member pivotable from a first position to a second position towards the vertically-curved section as a conveyor carrier moves into the vertically-curved section.

31 Claims, 3 Drawing Sheets

CONVEYOR SYSTEMS, STABILIZER ASSEMBLIES AND METHODS FOR STABILIZING CONVEYOR CARRIERS

FIELD OF THE INVENTION

This invention relates to conveyor systems, stabilizer assemblies and methods for stabilizing conveyor carriers.

BACKGROUND OF THE INVENTION

A conventional conveyor system generally includes a conveyor track and a number of conveyor carriers placed on the track. A conveyor carrier is usually subjected to a downward force exerted by the weight of the carrier and the load transported by the carrier. The conveyor carrier may also be subjected to lateral forces, such as a centrifugal force generated by the movement of the carrier when it travels along a curved segment of the conveyor track. Therefore, the conveyor track and carriers generally are designed to withstand downward and lateral forces but not upward forces. During some operations (during loading, for example), however, the conveyor carriers may be subjected to an upward force, which may cause it to move upwards and derail.

Stabilizers are used to jam and hold conveyor carriers in place when the carriers are subjected to upward forces. A typical conventional stabilizer has an elongated configuration, and is vertically mounted to a section of the conveyor track where the conveyor carriers may be subjected to upward forces. The stabilizers are placed just above the conveyor carriers. When it is subjected to an upward force and moves upwards, a conveyor carrier would come in contact with, and would be held in place by, one or more stabilizers.

One of the problems associated with conventional stabilizers is that they may interfere with the movement of conveys carriers as the carriers move into a vertically-curved section, such as an upwardly-curved section, of the conveyor track. As it moves into an upwardly-curved track section, a conveyor carrier is in an upwardly-inclined position with the front portion of the carrier on the upwardly-curved track section and the rear portion of the carrier on a horizontal section of the track. Because the track is curved and the conveyor carrier is straight, there will be an increased distance between the carrier's middle portion and the track. If there happens to be stabilizer positioned where the carrier's middle portion is, the middle portion of the conveyor carrier may come in contact with the stabilizer, preventing the conveyor carrier from moving farther up the upwardly-curved section of the conveyor track.

SUMMARY OF THE INVENTION

The present invention overcomes the drawbacks of the conventional stabilizers by providing conveyor systems, stabilizer assemblies, and methods, which allow a conveyor carrier to move into a vertically-curved section of the conveyor track without interference.

In accordance with one aspect of the invention, a stabilizer assembly includes a stabilizer member pivotable from a first position to a second position towards the vertically-curved section. The stabilizer member is at a substantially vertical position at the first position.

In accordance with another aspect of the invention, a stabilizer assembly includes a stabilizer member pivotable from a first position to a second position towards the vertically-curved section. The stabilizer member pivots from the first position towards the second position as the conveyor carrier moves into the vertically-curved section of the conveyor track.

In accordance with yet another aspect of the invention, a stabilizer assembly includes a stabilizer member pivotable from a first position to a second position towards the vertically-curved section. The stabilizer member is disposed at an operative distance from the vertically-curved section of the conveyor track.

In accordance with a further aspect of the invention, a method for stabilizing a conveyor carrier includes installing a stabilizer member adjacent to the vertically-curved section of the conveyor track, and pivoting the stabilizer member from a first vertical position towards a second position as the conveyor carrier moves into the vertically-curved section of the conveyor track.

In accordance with a yet further aspect of the invention, a conveyor system includes a conveyor track having a vertically-curved section, at least one conveyor carrier placed on the conveyor track for traveling along the conveyor track, and a stabilizer assembly. The stabilizer assembly includes a stabilizer member pivotable from a first position to a second position towards the vertically-curved section, wherein the stabilizer member is at a substantially vertical position at the first position.

In one preferred embodiment of the invention, the first position of the stabilizer member is 2° from the vertical position.

In another preferred embodiment of the invention, the second position of the stabilizer member is 16° from the vertical position.

In yet another preferred embodiment of the invention, the stabilizer member is positioned within a load station of the conveyor system.

In still yet another preferred embodiment of the invention, the stabilizer member may be pivotably mounted to the conveyor track.

In still yet another preferred embodiment of the invention, the stabilizer assembly may include a cross bar transversely mounted to the conveyor track, and the stabilizer member is pivotably mounted to the cross bar.

In a further preferred embodiment of the invention, the cross bar may have a middle section and first and second ends, and the stabilizer member may include first and second arms. The middle section of the cross bar is mounted to the conveyor track, and the first and second arms of the stabilizer member are pivotably mounted to the first and second ends of the cross bar, respectively.

In a yet further preferred embodiment of the invention, the stabilizer assembly may include a counterweight, which biases the stabilizer member towards the first position.

In a still yet further preferred embodiment of the invention, the stabilizer assembly may include an adjustment mechanism that adjusts the location of the first position.

The conveyor systems, stabilizer assemblies, and the methods of the present invention have a number of advantages over the prior art. For example, even if it is placed adjacent to a vertically-curved section of the conveyor track, the stabilizer assemblies of the present invention do not substantially interfere with the movement of conveyor carriers. In addition, the stabilizer assemblies of the present invention are structurally simple, and inexpensive to manufacture and install. Further, the operation of the assemblies is simple and reliable, and do not require any actions on the part of the operator or the conveyor control system.

DESCRIPTION OF PREFERRED EMBODIMENTS

Figure 1:
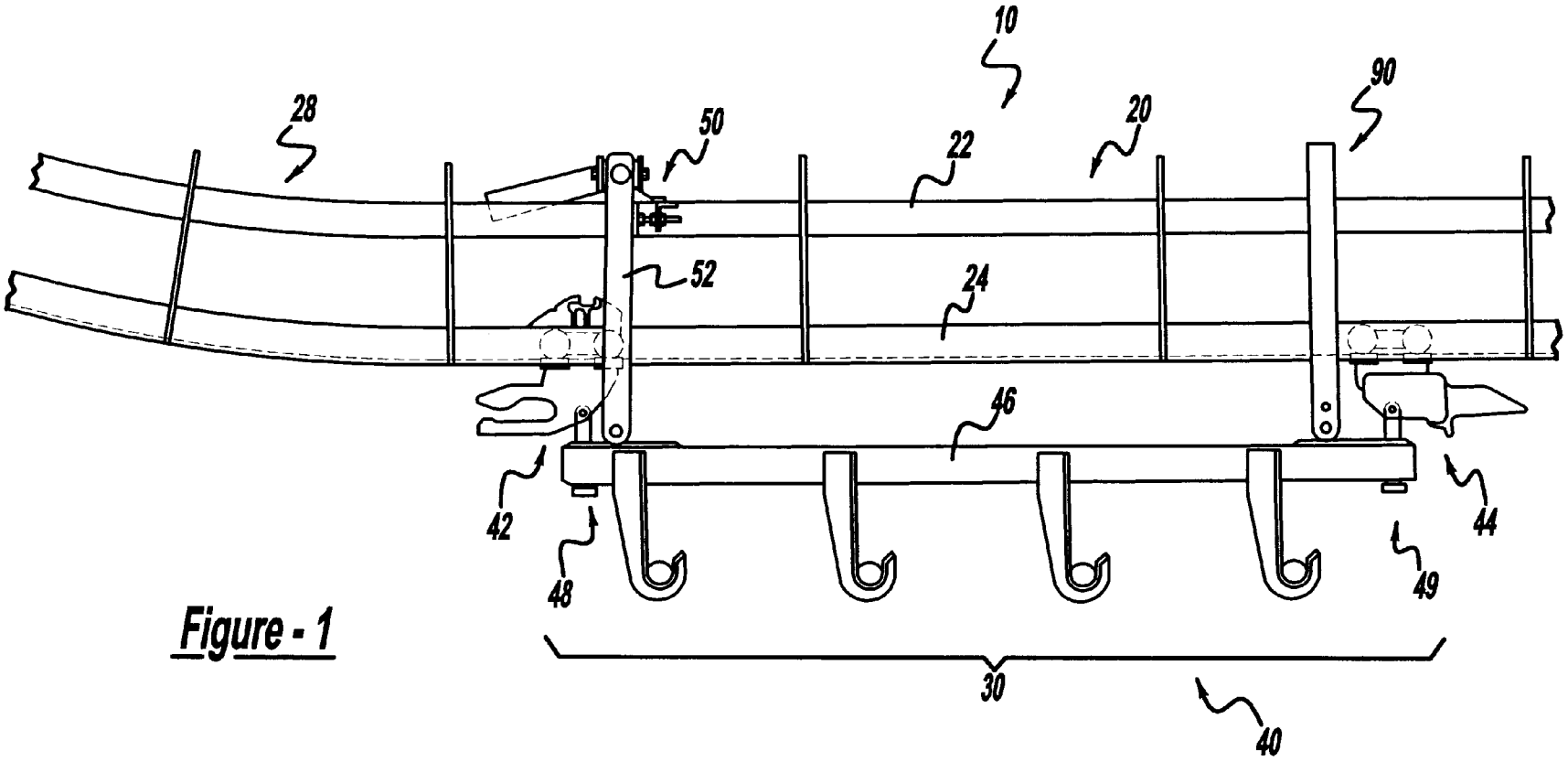
FIG. 1 is a side view of a conveyor system of the present invention.

FIG. 1 illustrates a conveyor system 10 of the present invention. The conveyor system 10 includes a conveyor track 20, at least one conveyor carrier 40 placed on the conveyor track 20 for traveling along the conveyor track 20, and a stabilizer assembly 50.

The conveyor system 10 illustrated in FIG. 1 is a power and free conveyor system, although the conveyor system of the present invention may be a conveyor system of any type. The conveyor track 20 of the power and free conveyor system includes a power track 22 and a free track 24, which are parallelly arranged and mounted to conveyor yokes 26 (see also FIG. 2). The conveyor track 20 also includes a vertically-curved section 28, which may be an upwardly-curved or downwardly-curved section, and a load station 30 positioned adjacent to the vertically-curved section 28.

The conveyor carrier 40 may include a front trolley 42 and a rear trolley 44, and a load bar 46 connecting the front and rear trolleys 42, 44. Both trolleys 42, 44 are mounted on the free track 24 for traveling along the free track 24. The conveyor system 10 may also include a power chain (not shown) placed in the power track 22, which power chain is used to move the conveyor carrier 40 along the free track 24.

Figure 3:
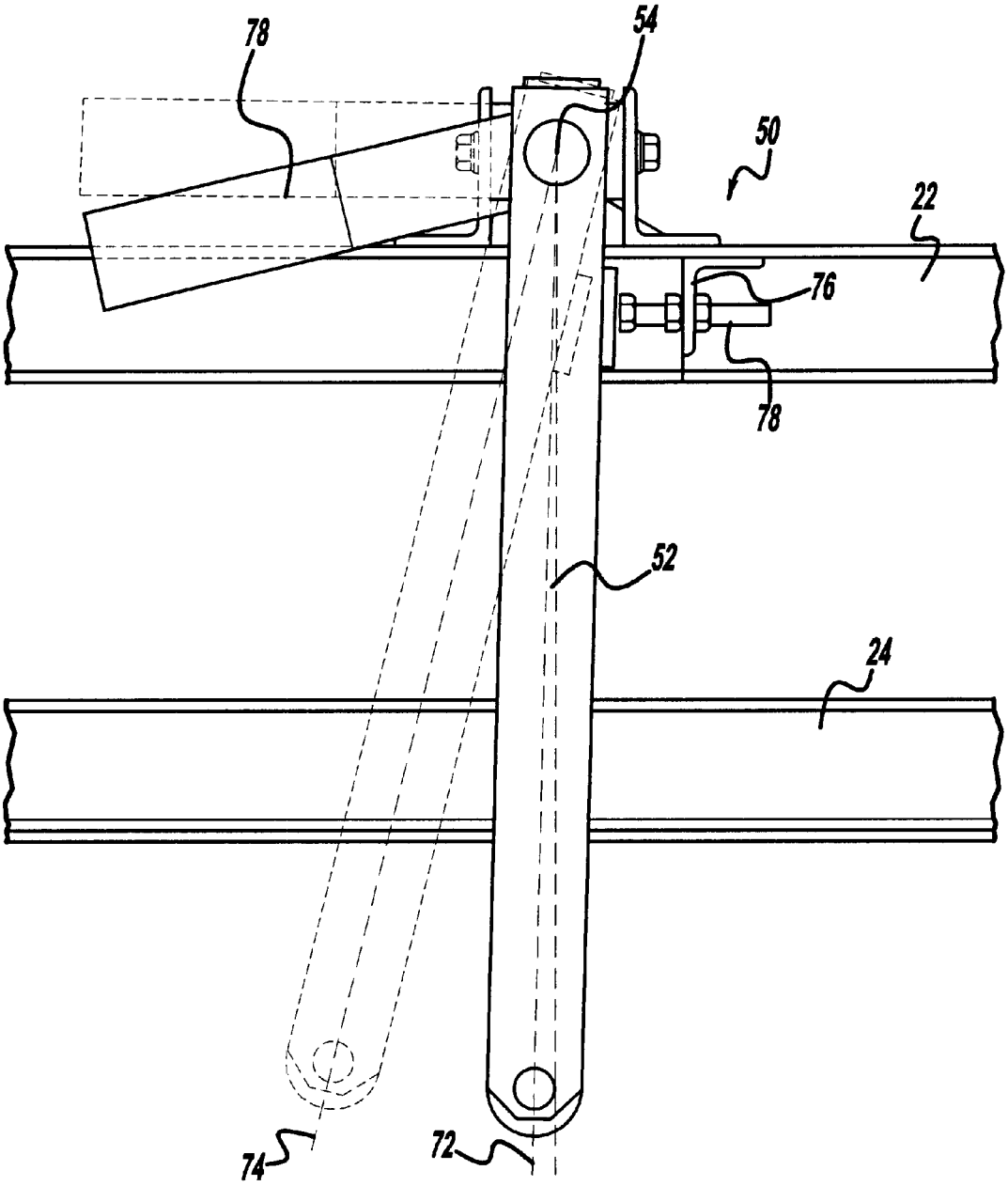
FIG. 3 is a side view of the pivotable stabilizer assembly of the conveyer system shown in FIG. 1.

The stabilizer assembly 50 is usually used in the load station 30 to jam and hold the conveyor carrier 40 in position when the conveyor carrier 40 is being loaded or unloaded. The stabilizer assembly 50 may also be used outside of the load station 30 for the same purpose or similar purposes. As shown in FIG. 3, the stabilizer assembly 50 includes a stabilizer member 52, which is pivotably connected to the conveyor track 20. In general, however, the stabilizer member 52 may be pivotably connected to any structure, including a structure that is not part of the conveyor system 10, such as the roof of the building in which the conveyor system 10 is installed. In the illustrated embodiment, the pivot point 54 for the stabilizer member 52 is at its upper end, although the pivot point may be located anywhere on the stabilizer member 52.

Figure 2:
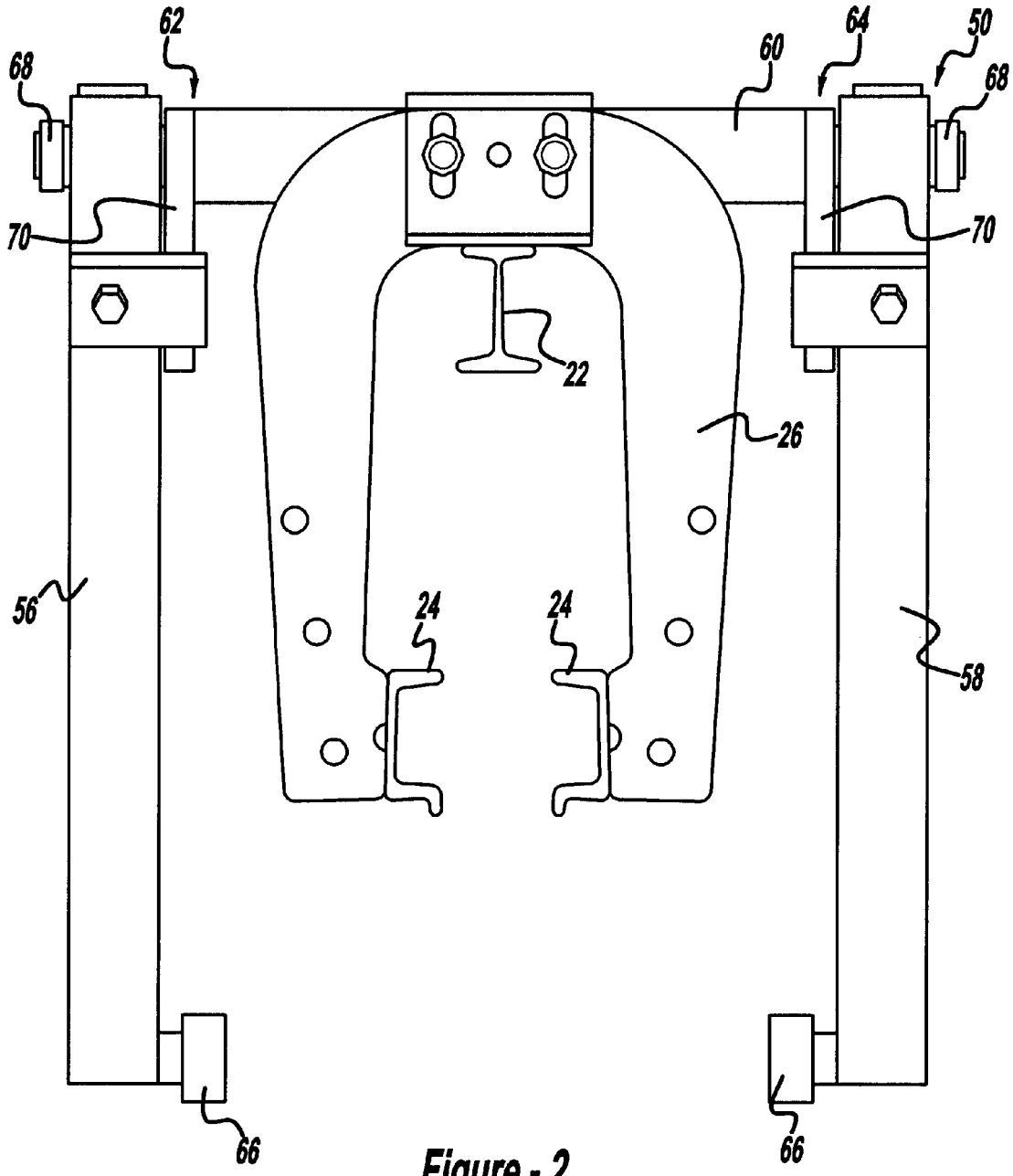
FIG. 2 is a longitudinal view of the conveyor track and the pivotable stabilizer assembly of the conveyer system shown in FIG. 1.

The stabilizer member 52 may have any suitable configuration. In the illustrated embodiment, the stabilizer member 52 has first and second arms 56, 58 pivotably mounted at the first and second ends 62, 64 of a cross bar 60, as shown in FIG. 2. The two arms 56, 58 may pivot together or independently. Each stabilizer arm 56, 58 may include a roller 66 at its free end. Preferably, each of the cross bar 60 and stabilizer arms 56, 58 is constructed from a hollow square or rectangular tube, which reduces the weight of the arm 56, 58, 60 without compromising its strength and stiffness. The cross bar 60 is transversely mounted to the top of one of the track yokes 26, and the first and second arms 56, 58 of the stabilizer member 52 are positioned on the two sides of the conveyor track 20, respectively. Although in the illustrated embodiment the stabilizer member 52 has a two-arm configuration, the stabilizer member of the present invention may have a single element that is positioned on either side, or in the middle, of the conveyor track, and the single element may have any suitable configuration, such as an elongated, rectangular, elliptical or spherical configuration. Moreover, the stabilizer member may have more than two elements. In some applications, the two-arm stabilizer member 52 has a number of advantages over a single-arm stabilizer member. For example, if the conveyor carrier is subjected to an upward loading force that is not vertically aligned with the jamming force of a single-arm stabilizer member, the loading and jamming forces apply a torque to the conveyor carrier and may cause the conveyor carrier to turn. The two-arm stabilizer member tends not to cause this problem.

The stabilizer arms 56, 58 may be pivotably mounted to the cross bar 60 in any suitable manner. In the illustrated embodiment, as shown in FIG. 2, the stabilizer assembly 50 includes a pivot rod 68, which extends through the hollow center, and beyond the two ends 62, 64, of the cross bar 60, and the stabilizer arms 56, 58 may be attached to the respective ends of the pivot rod 68 and may rotate with the pivot rod 68 about its axis. In the illustrated embodiment, the stabilizer arms 56, 58 are not directly attached to the ends of the pivot rod 68. Instead, a pivot plate 70 is used to attach each stabilizer arm 56, 58 securely to the pivot rod 68. The pivot plate 70 is bolted to the stabilizer arm 56, 58 and is fixed to, and rotates with, the pivot rod 68. The cross bar 60 preferably has the necessary structure to accommodate the pivot rod 68 and allow it to rotate about its axis.

Preferably, the stabilizer member 52 is pivotable between a first position 72 and a second position 74. At the first position 72, the stabilizer member 52 is used to jam and hold the conveyor carrier 40 in position when the conveyor carrier 40 moves upwards. This upward movement of the conveyor carrier 40 may be caused by an upward loading force, for example. As the conveyor carrier 40 moves into the vertically-curved section 28 of the conveyor track 20, the stabilizer member 52 no longer jams the conveyor carrier 40 rather pivots from the first position 72 towards or to the second position 74, allowing the conveyor carrier 40 to move into the vertically-curved track section 28 without interference from the stabilizer member 52. A non-pivotable conventional stabilizer, on the other hand, may interfere with this movement of the conveyor carrier.

Preferably, the first position 72 of the stabilizer member 52 is chosen such that when it is jamming and holding the conveyor carrier 40 in position, the stabilizer member 52 remains at the first position 72 (i.e., does not pivot towards the second position 74). Further, as the conveyor carrier 40 moves into the vertically-curved section 28, the stabilizer member 52 preferably pivots from the first position 72 towards the second position 74 (i.e., does not stay at the first position 72 and interfere with the movement of the conveyor carrier 40). One of the differences between the conveyor carrier's movement under an upward loading force and its movement as it moves into a vertically-curved track section 28 is that the former movement generally includes a greater vertical component than does the later movement, while the later movement generally includes a greater horizontal component than does the former movement. Therefore, the first position 72 of the stabilizer member 52 preferably is substantially vertical in order for the stabilizer member 52 to function as described above. In the illustrated embodiment, the first position 72 of the stabilizer member 52 is preferably between the vertical position and 15° from the vertical position towards the second position inclusive, more preferably between the vertical position and 5° from the vertical position towards the second position inclusive, most preferably at 2° from the vertical position. The vertical position is defined herein as the position of the stabilizer member where the point at which the stabilizer member contacts the conveyor carrier is right below the pivot point, i.e., the straight line passing through the contact and pivot points is vertical.

Preferably, the first position 72 of the stabilizer member 52 can be adjusted according to operating conditions. A stabilizer member with a smaller first position (i.e., a smaller angle) is more stable (i.e., tends not to pivot) when it is used to jam a conveyor carrier, but does not pivot easily, thus is more likely to interfere with the movement of the conveyor carrier as it moves into a vertically-curved section. On the other hand, a stabilizer member with a larger first position (i.e., a larger angle) is less stable but is less likely to interfere with the movement of the conveyor carrier as it moves into a vertically-curved section. While the first position 72 of the stabilizer member 52 can be adjusted using any suitable adjustment mechanism, the illustrated stabilizer assembly 50 uses an adjustment mechanism, which includes a bracket 76 mounted to the conveyor track 20 and an adjustment bolt 78 threadedly engaged with the bracket 76, as shown in FIG. 3. The first position 72 of the stabilizer member 52 can be adjusted by rotating the adjustment bolt 78.

The second position 74 of the stabilizer member 52 is between the first position 72 and the vertically-curved section 28 of the conveyor track 20. Preferably, the second position 74 is such that the stabilizer member 52 does not need to pivot beyond the second position 74 as the conveyor carrier 40 moves into the vertically-curved track section 28. The minimum second position is determined from a number of factors, such as the distance between the stabilizer member 52 and the vertically-curved section 28 of the conveyor track 20, the distance between the pivot and contact points of the stabilizer member 52, the gap between the stabilizer member 50 and the top surface of the conveyor carrier 40; the radius of the vertically-curved track section 28, and the length of the conveyor carrier 40. In many cases, the minimum second position can be determined by trial and error. In the illustrated embodiment, the second position 74 is preferably between the first position 72 and 40° from the vertical position, more preferably between the first position 72 and 30° from the vertical position, most preferably at 16° from the vertical position.

The distance between the stabilizer member 52 and the vertically-curved track section 28 may also affect the operation of the stabilizer assembly 50. If the distance between the stabilizer member 52 and the vertically-curved track section 28 is too close, the stabilizer member 52 may interfere with the movement of the conveyor carrier 40 as the carrier moves 40 into the vertically-curved track section 28. This may occur even if the stabilizer member 52 pivots towards the vertically-curved track section 28 as the conveyor carrier 40 moves into the vertically-curved track section 28. Therefore, the stabilizer member 52 is preferably positioned at a distance sufficiently far from the vertically-curved track section 28 so as not to interfere with the conveyor carrier's movement. On the other hand, if it is positioned sufficiently far from the vertically-curved track section and thus would not interfere with the conveyor carrier's movement into the vertically-curved track section 28, a pivotable stabilizer assembly may not be needed. Therefore, it is preferred that the stabilizer member 52 of the present invention be positioned at an operative distance from the vertically-curved track section 28, which operative distance is defined as a distance not too close to, or too far from, the vertically-curved track section 28, as discussed above. The minimum and maximum operative distances are determined by a number of factors, such as the distance between the pivot and contact points of the stabilizer member 52, the gap between the stabilizer member 52 and the conveyor carrier 40, the radius of the vertically-curved track section 28, the length of the conveyor carrier 40, and the location of the second position 74. Usually, the minimum and maximum operative distances can be determined by trial and error.

The stabilizer assembly 50 may also include a counterweight 80, which is used to bias the stabilizer member 52 towards the first position 72. The counterweight 80 ensures that the stabilizer member 52 returns and stays at the first position 72 when the stabilizer member 52 is not subjected to external forces and/or torques, and it also reduces the tendency of the stabilizer member 52 to pivot when the stabilizer member 52 is used to jam conveyor carriers. In general, the counterweight 80 may have any suitable configuration and may be placed at any suitable location so long as it can accomplish its functions. In the illustrated embodiment, for example, the counterweight 80 has a generally elongated configuration and is attached to the stabilizer member 52 at the pivot point 54, as shown in FIG. 3. The gravitational force of the counterweight 80 urges the stabilizer member 52 in the direction of the first position 72, thus biasing the stabilizer member 52 towards the first position 72. Preferably, when the stabilizer member 52 is at the second position 72, the counterweight 80 extends substantially horizontally in the direction of the vertically-curved section 28 of the conveyor track. Alternatively, the counterweight 80 may be attached to any portion of the stabilizer member 52, such as the middle portion or the free end potion. In addition, the counterweight 80 may be attached to the stabilizer member 52 in any suitable manner and may form a unitary or integral part with the stabilizer member 52.

In the illustrated embodiment, as shown in FIG. 1, the conveyor system 10 may include a second stabilizer assembly 90. This second stabilizer assembly 90 preferably is also a two-arm stabilizer and is positioned in the load station 30. Preferably, the first stabilizer member 52 is aligned with the front end 48 of the conveyor carrier 40, and the second stabilizer member 52 is aligned with the rear end 49. With a stabilizer arm at each of the four corners of the conveyor carrier 40, this arrangement is much more effective in stabilizing the conveyor carrier 40. Since it is farther away from the vertically-curved track section 28 than the first stabilizer assembly 50 is, the second stabilizer assembly 90 tends not to interfere with the movement of the conveyor carrier 40 into the vertically-curved track section 28. If it does not interfere with the movement of the conveyor carrier, the second stabilizer assembly 90 may be a non-pivotable stabilizer, as shown in FIG. 1; otherwise, the second stabilizer assembly may also be pivotable.

With reference to the preferred embodiment shown in FIGS. 1–3, the operation of the conveyor system 10 of the present invention may be described as follows. A conveyor carrier 40 is first introduced into the load station 30 of the conveyor system 10 for loading or unloading. When the conveyor carrier 40 is in the load station 30, the first stabilizer assembly 50 preferably is aligned with the carrier's front end 48, and the second stabilizer assembly 90 is preferably aligned with the carrier's rear end 49. The four stabilizer arms of the stabilizer assemblies 50, 90 are aligned with the four corners of the conveyor carrier 40. If the conveyor carrier 40 is subjected to loading forces that cause the conveyor carrier 40 to move upward, the stabilizer arms jam and hold the conveyor carrier 40 in position. Preferably, in doing so, the pivotable stabilizer arms stay in their first positions (i.e., they do not pivot towards to the second positions). After it is loaded (or unloaded), the conveyor carrier 40 moves out of the load station 30 and into the vertically-curved section 28 of the conveyor track 20. As this happens, the pivotable stabilizer member 52 pivots from its first position 72 towards or to its second position 74, allowing the conveyor carrier 40 to move into the vertically-curved section 28 without interference. After the conveyor carrier 40 has left the load station 30, the pivotable stabilizer member 52 returns to the first position 72.

What is claimed is:

1. A stabilizer assembly for use in a conveyor system including a conveyor carrier disposed on a conveyor track having a vertically-curved section, the stabilizer assembly comprising a stabilizer member pivotable from a first position to a second position towards the vertically-curved section of the conveyor track, wherein the stabilizer member is at a substantially vertical position at the first position.

2. The stabilizer assembly of claim 1, wherein the stabilizer member pivots from the first position towards the second position as the conveyor carrier moves into the vertically-curved section of the conveyor track.

3. The stabilizer assembly of claim 2, wherein the stabilizer member is positioned at an operative distance from the vertically-curved section of the conveyor track.

4. The stabilizer assembly of claim 1, wherein the stabilizer member is positioned within a load station of the conveyor system.

5. The stabilizer assembly of claim 1, wherein the first position is 2° from the vertical position.

6. The stabilizer assembly of claim 1, wherein the second position is 16° from the vertical position.

7. The stabilizer assembly of claim 1, wherein the stabilizer member is pivotably mounted to the conveyor track.

8. The stabilizer assembly of claim 1 further including a cross bar transversely mounted to the conveyor track, wherein the stabilizer member is pivotably mounted to the cross bar.

9. The stabilizer assembly of claim 8, wherein the cross bar has a middle section and first and second ends, the middle section of the cross bar being mounted to the conveyor track, and wherein the stabilizer member includes first and second arms pivotably mounted at the first and second ends of the cross bar, respectively.

10. The stabilizer assembly of claim 1 further including a counterweight, wherein the counterweight biases the stabilizer member towards the first position.

11. The stabilizer assembly of claim 1 further including an adjustment mechanism that adjusts the location of the first position.

12. A stabilizer assembly for use in a conveyor system including a conveyor carrier disposed on a conveyor track having a vertically-curved section, the stabilizer assembly comprising a stabilizer member pivotable from a first position to a second position towards the vertically-curved section of the conveyor track, wherein the stabilizer member pivots from the first position towards the second position as the conveyor carrier moves towards the vertically-curved section of the conveyor track.

13. The stabilizer assembly of claim 12, wherein the stabilizer member is positioned at an operative distance from the vertically-curved section of the conveyor track.

14. The stabilizer assembly of claim 12, wherein the first position is 2° from the vertical position.

15. The stabilizer assembly of claim 12 further including a counterweight, wherein the counterweight biases the stabilizer member towards the first position.

16. The stabilizer assembly of claim 12 further including an adjustment mechanism that adjusts the location of the first position.

17. A stabilizer assembly for use in a conveyor system including a conveyor carrier disposed on a conveyor track having a vertically-curved section, the stabilizer assembly comprising a stabilizer member pivotable from a first position to a second position towards the vertically-curved section, wherein the stabilizer member is positioned at an operative distance from the vertically-curved section of the conveyor track.

18. The stabilizer assembly of claim 17, wherein the stabilizer member is at a substantially vertical position at the first position.

19. The stabilizer assembly of claim 17, wherein the first position is 2° from the vertical position.

20. A method for stabilizing a conveyor carrier used in a conveyor system including a conveyor track having a vertically-curved section, the method including:

installing a stabilizer member adjacent to the vertically-curved section of the conveyor track; and pivoting the stabilizer member from a first vertical position towards a second position as the conveyor carrier moves into the vertically-curved section of the conveyor track.

21. The method of claim 20, wherein the step of installing the stabilizer member includes placing the stabilizer member at an operative distance from the vertically-curved section of the conveyor track.

22. The method of claim 21, wherein the step of installing the stabilizer member includes placing the stabilizer member within a load station of the conveyor system.

23. The method of claim 22 further including installing a counterweight, wherein the counterweight biases the stabilizer member towards the first position.

24. The method of claim 23 further including adjusting the location of the first position of the stabilizer member.

25. A conveyor system comprising:

a conveyor track having a vertically-curved section;

at least one conveyor carrier placed on the conveyor track for traveling along the conveyor track; and a stabilizer assembly including a stabilizer member pivotable from a first position to a second position towards the vertically-curved section, wherein the stabilizer member is at a substantially vertical position at the first position.

26. The conveyor system of claim 25, wherein the stabilizer member pivots from the first position towards the second position as the conveyor carrier moves towards the vertically-curved section of the conveyor track.

27. The conveyor system of claim 26, wherein the stabilizer member is positioned at an operative distance from the vertically-curved section of the conveyor track.

28. The conveyor system of claim 27, wherein the stabilizer assembly includes a counterweight, wherein the counterweight biases the stabilizer member towards the first position.

29. The conveyor system of claim 28, wherein the stabilizer assembly includes an adjustment mechanism that adjusts the location of the first position.

30. The conveyor system of claim 29, wherein the stabilizer assembly is a first stabilizer assembly, and the conveyor system includes a second stabilizer assembly that is positioned farther away from the vertically-curved section than the first stabilizer assembly.

31. The conveyor system of claim 30, wherein the second stabilizer assembly is not a pivotable stabilizer assembly.

* * * * *